US007223300B2

(12) United States Patent
Chevli

(10) Patent No.: US 7,223,300 B2
(45) Date of Patent: May 29, 2007

(54) INKJET INK SET

(75) Inventor: Samit N. Chevli, Hockessin, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 52 days.

(21) Appl. No.: 11/253,454

(22) Filed: Oct. 19, 2005

(65) Prior Publication Data

US 2007/0085888 A1 Apr. 19, 2007

(51) Int. Cl.
*C09D 11/02* (2006.01)
*B41J 2/01* (2006.01)

(52) U.S. Cl. ..... 106/31.27; 347/100

(58) Field of Classification Search ..... 106/31.27; 347/100
See application file for complete search history.

(56) References Cited

U.S. PATENT DOCUMENTS 5,635,970 A * 6/1997 Shirota et al. ..... 347/100
5,910,812 A * 6/1999 Yamamoto et al. ..... 347/106
6,336,721 B1 1/2002 Provost et al.
6,426,766 B1 * 7/2002 Shirota et al. ..... 347/106
6,508,549 B1 1/2003 Romano, Jr. et al.
6,588,879 B2 7/2003 Kushner et al.
2004/0100643 A1 5/2004 Jones et al.
2004/0160500 A1 * 8/2004 Itoh et al. ..... 347/100
2005/0041082 A1 * 2/2005 Kataoka ..... 347/100
2005/0171239 A1 * 8/2005 Bauer et al. ..... 106/31.6
2005/0171240 A1 * 8/2005 Bauer et al. ..... 106/31.6
2005/0235867 A1 10/2005 Jackson et al.
2005/0284329 A1 * 12/2005 Jackson et al. ..... 106/31.6
2005/0284330 A1 * 12/2005 Jackson ..... 106/31.6
2006/0082629 A1 * 4/2006 Kato et al. ..... 106/31.27
2006/0082630 A1 * 4/2006 Kato et al. ..... 106/31.27
2006/0185099 A1 * 8/2006 Chevli ..... 8/471

* cited by examiner

*Primary Examiner*—Helene Klemanski
(74) *Attorney, Agent, or Firm*—Steven C. Benjamin; Bart E. Lerman

(57) ABSTRACT

The present invention pertains to a dye-based inkjet ink set that includes a red disperse dye and, more particularly, to a dye-based inkjet ink set suitable for printing on polyester and polyester blends fabrics. The present invention also pertains to a method for printing polyester and polyester blends fabrics with the dye-based inkjet ink set, and a polyester and polyester blends fabrics so printed.

14 Claims, No Drawings

INKJET INK SET

BACKGROUND OF THE INVENTION

The present invention pertains to a dye-based inkjet ink set and, more particularly, to a dye-based inkjet ink set suitable for printing on polyester and polyester blend fabrics.

Digital printing methods such as inkjet printing are becoming increasingly important for the printing of textiles and offer a number of potential benefits over conventional printing methods such as screen printing. Digital printing eliminates the set up expense associated with screen preparation and can potentially enable cost effective short run production. Inkjet printing furthermore allows visual effects, like infinite pattern repeat sizes, that cannot be practically achieved with a screen printing process.

One area of textile printing ideally suited to digital printing is for printing polyester and polyester blends, where disperse dyes are optimized for effective digital printing. Cyan, magenta and yellow (CMY) disperse dye ink sets for digital printing satisfy most of the needs for textile printing; however, other supplemental colors may be needed to obtain a sufficient color gamut for textile printing.

One particular shortcoming in the gamut of many CMY-based commercial color sets is a difficulty in achieving the bright red colors needed for printed items like the American Flag and the "Ferrari Red" often found in automotive advertising.

It is thus an object of this invention to provide an inkjet ink set having good color gamut, especially in the red region, with the individual inks having good penetration properties that are advantageous for printing on polyester and polyester blend fabrics.

SUMMARY OF THE INVENTION

In accordance with one aspect of the present invention, there is provided an inkjet ink set comprising at least four differently colored inks, wherein:

at least one of the colored inks is red in color ("R" ink) and comprises a first aqueous vehicle and a red disperse dye colorant selected from the group consisting of DR177, DR229, DR258 and mixtures thereof;

at least one of the colored inks is cyan in color ("C" ink) and comprises a second aqueous vehicle and a cyan disperse dye colorant, wherein the cyan disperse dye colorant comprises DB60;

at least one of the colored inks is magenta in color ("M" ink) and comprises a third aqueous vehicle and a magenta disperse dye colorant selected from the group consisting of DR5, DR75, DR76, DR121, DR132, DR179, DR184, DR189, DR191 and mixtures thereof;

at least one of the colored inks is yellow in color ("Y" ink) and comprises a fourth aqueous vehicle and a yellow disperse dye colorant selected from the group consisting of DY27, DY33, DY50, DY59, DY98, DY114, DY139, DY140, DY201, DY206, DY231 and mixtures thereof.

In another preferred embodiment, the ink set further comprises an ink that is black in color ("K" ink) comprising a sixth aqueous vehicle and a black disperse dye colorant.

In addition to the RCMY (and optional K) inks, the ink sets may further comprise one or more additional "gamut-expanding" inks, including inks such as an orange ink, a green ink, a violet ink and/or a blue ink, as well as combinations of full strength and light strength inks such as light cyan, light magenta and light black.

In yet another aspect, the present invention pertains to a method for ink jet printing onto a fabric substrate, comprising the steps of:

(a) providing an ink jet printer that is responsive to digital data signals;

(b) loading the printer with a fabric substrate to be printed, preferably a polyester or polyester blend fabric substrate;

(c) loading the printer with an inkjet ink set as set forth above; and (d) printing onto the fabric substrate using the inkjet ink set in response to the digital data signals.

Optionally (and preferably), the process further comprises the following steps:

(e) fixing the disperse dye inks, preferably by steam treating the printed fabric substrate to set the print; and (f) washing the digitally printed (steam-treated) fabric.

In still another aspect, the present invention pertains to a polyester or polyester blend fabric article printed according the above inkjet printing method. Flag and banner fabrics may also be printed according to the above inkjet printing method.

These and other features and advantages of the present invention will be more readily understood by those of ordinary skill in the art from a reading of the following detailed description. It is to be appreciated that certain features of the invention which are, for clarity, described above and below in the context of separate embodiments, may also be provided in combination in a single embodiment. Conversely, various features of the invention that are, for brevity, described in the context of a single embodiment, may also be provided separately or in any subcombination. In addition, references in the singular may also include the plural (for example, "a" and "an" may refer to one, or one or more) unless the context specifically states otherwise. Further, reference to values stated in ranges include each and every value within that range.

DETAILED DESCRIPTION OF THE PREFERRED EMBODIMENTS

Inks and Ink Sets

The term "ink set" refers to all the individual inks or other fluids an inkjet printer is equipped to jet. The ink set of the present invention contains at least a red, a cyan, a magenta and a yellow ink.

The inks of the present ink set are characterized by the presence of particular, specified colorants in an aqueous vehicle. The colorants are disperse dyes, which are substantially insoluble in the aqueous vehicle. These disperse dyes are dispersed by common dispersants and dispersing techniques used in the manufacture of ink jet inks, which dispersants. Dispersants and dispersing techniques are in general well-known to those of ordinary skill in the relevant art.

Reference to the specified dyes is made by their "C.I." designation established by Society Dyers and Colourists, Bradford, Yorkshire, UK and published in the *The Color Index*, Third Edition, 1971. Sources of these dyes are generally well known to those of ordinary skill in the relevant art.

In addition to the RCMY inks as defined above, the ink sets in accordance with the present invention may contain differently colored disperse dye inks, as well as different strength versions of the RCMY and other inks. Five-, six-, seven-, eight- and even higher-member differently colored ink sets can be constructed in any combination. As with the RCMY inks, any differently colored (or strength) inks preferably comprise an appropriately colored disperse dye colorant (one disperse dye or a combination of disperse dyes that result in the appropriate color) in an aqueous vehicle.

A preferred (but non-limiting) example of an additional ink for the ink set includes an ink that is black in color, comprising a sixth aqueous vehicle and a black disperse dye colorant. The black disperse dye colorant can be a black disperse dye, but is preferably a mixture of differently colored disperse dyes chosen such that the mixture is black in color, such as a mixture of DB291:1, DO29, and one or both of DV63 or DV99; or a mixture of DB77, DR92 and DY114.

Another preferred (but non-limiting) example of another colored ink for the ink set is a violet ink, such as a violet ink comprising a fifth aqueous vehicle and a disperse dye colorant selected from the group consisting of DV37, DV57, DV63, DV99 and mixtures thereof.

As a preferred (but non-limiting) example of the use of different strength inks, the inks sets of the present invention can comprise full-strength versions of the C and M inks, and "light" versions of one or any combination of the C and M inks (denoted as "c" and "m" inks). The black ink may also preferably be used as a full-strength and light version (denoted as "k").

A preferred ink set comprises the following 8 inks: RCMYKVcm. Each of these inks preferably comprises, individually, an aqueous vehicle (which can be the same or different for each ink) and an appropriate disperse dye colorant.

A preferred use for the aforementioned RCMY ink sets is to provide for excellent coloring especially in the 'red' region.

Aqueous Vehicle

The vehicle is a carrier for the colorant. An "aqueous vehicle" refers to a vehicle comprised of water or a mixture of water and at least one water-soluble organic solvent (co-solvent). Selection of a suitable mixture depends on requirements of the specific application, such as desired surface tension and viscosity, the selected colorant, and compatibility with substrate onto which the ink will be printed.

Examples of water-soluble organic solvents include alcohols, ketones, ketoalcohols, ethers and others, such as thiodiglycol, sulfolane, 2-pyrrolidone, 1,3-dimethyl-2-imidazolidinone and caprolactam; glycols such as ethylene glycol, diethylene glycol, tri-triethylene glycol, tetraethylene glycol, propylene glycol, dipropylene glycol, tripropylene glycol, trimethylene glycol, butylene glycol and hexylene glycol; addition polymers of oxyethylene or oxypropylene such as polyethylene glycol, polypropylene glycol and the like; triols such as glycerol and 1,2,6-hexanetriol; lower alkyl ethers of polyhydric alcohols, such as ethylene glycol monomethyl ether, ethylene glycol monoethyl ether, diethylene glycol monomethyl, diethylene glycol monoethyl ether; lower dialkyl ethers of polyhydric alcohols, such as diethylene glycol dimethyl or diethyl ether.

An aqueous vehicle will typically contain about 30% to about 95% water with the balance (i.e., about 70% to about 5%) being the water-soluble solvent.

Additives

Other ingredients, additives, may be formulated into the inkjet ink, to the extent that such other ingredients do not interfere with the stability and jetability of the finished ink, which may be readily determined by routine experimentation. Such other ingredients are in a general sense well known in the art.

Commonly, surfactants are added to the ink to adjust surface tension and wetting properties. Suitable surfactants include ethoxylated acetylene diols (e.g. Surfynols® series from Air Products), ethoxylated primary (e.g. Tomadol® series from Tomah Products) and secondary (e.g. Tergitol® series from Union Carbide) alcohols, sulfosuccinates (e.g. Aerosol® series from Cytec), organosilicones (e.g. Silwet® series from GE Silicons) and fluoro surfactants (e.g. Zonyl® series from DuPont). Surfactants are typically used in the amount of about 0.01 to about 5% and preferably about 0.2 to about 2%, based on the total weight of the ink.

Polymers may be added to the ink to improve durability. The polymers can be soluble in the vehicle or dispersed (e.g. "emulsion polymer" or "latex"), and can be ionic or non-ionic. Useful classes of polymers include acrylics, styrene-acrylics, polyurethanes and crosslinked polyurethanes.

Biocides may be used to inhibit growth of microorganisms. Buffers may be used to maintain pH. Buffers include, for example, tris(hydroxymethyl)-aminomethane ("Trizma" or "Tris").

Inclusion of sequestering (or chelating) agents such as ethylenediaminetetraacetic acid (EDTA), iminodiacetic acid (IDA), ethylenediamine-di(o-hydroxyphenylacetic acid) (EDDHA), nitrilotriacetic acid (NTA), dihydroxyethylglycine (DHEG), trans-1,2-cyclohexanediaminetetraacetic acid (CyDTA), dethylenetriamine-N,N,N',N",N"-pentaacetic acid (DTPA), and glycoletherdiamine-N,N,N',N'-tetraacetic acid (GEDTA), and salts thereof, may be advantageous, for example, to eliminate deleterious effects of heavy metal impurities.

Proportions of Ingredients

The components described above can be combined to make an ink in various proportions and combinations in order to achieve desired ink properties, as generally described above, and as generally recognized by those of ordinary skill in the art. Some experimentation may be necessary to optimize inks for a particular end use, but such optimization is generally within the ordinary skill in the art.

The amount of vehicle in an ink is typically in the range of from about 70 wt % to about 99.8 wt %, and more typically from about 80 wt % to about 99 wt %. Colorant is generally present in amounts of about 15 wt % or less (dye solids), preferably from about 0.15 wt % to about 15 wt %. For flag and banner applications, the colorant is typically in the range of from about 3 wt % to about 12 wt %. In one preferred application, the colorant is present in the ink in an amount of from about 4 wt % to about 8 wt %. Percentages are weight percent of the total weight of the ink.

Other ingredients (additives), when present, generally comprise less than about 15 wt %, based on the total weight of the ink. Surfactants, when added, are generally in the range of from about 0.2 wt % to about 3 wt %, based on the total weight of the ink. Polymers can be added as needed, but will generally be less than about 15 wt %, based on the total weight of the ink.

Ink Properties

Drop velocity, separation length of the droplets, drop size and stream stability are greatly affected by the surface tension and the viscosity of the ink. Ink jet inks typically have a surface tension in the range of about 20 dyne/cm to about 70 dyne/cm at 25° C. Viscosity can be as high as 30 cP at 25° C., but is typically somewhat lower. The ink has physical properties are adjusted to the ejecting conditions and printhead design. The inks should have excellent storage stability for long periods so as not clog to a significant extent in an ink jet apparatus. Further, the ink should not corrode parts of the ink jet printing device it comes in contact with, and it should be essentially odorless and non-toxic.

Substrate

The instant ink set is especially advantageous for printing a substrate that is synthetic polyester and/or polyester blends fabric. An example of a polyester fabric is a 600 Denier polyester from Pacific Coast Fabrics, Gardena, Calif.

These types of fabric are commonly pretreated prior to printing. Suitable pretreatments for such fabrics are in general well known to those of ordinary skill in the relevant art, and application of the pretreatment to the fabric can be any convenient method, such methods also being generally well known to those of ordinary skill in the relevant art.

One example of a preferred pretreatment application method is referred to as padding. In padding, a fabric is dipped in the pretreatment solution, then the saturated fabric is passed through nip rollers that squeeze out the excess solution. The amount of solution retained in the fabric can be regulated by the nip pressure applied by the rollers. Other pretreatment techniques include spray application wherein the solution is applied by spraying on the face or face and back of the fabric. The wet pick-up of pretreatment solution is preferably from about 20 and about 100% wet pick-up, more preferably from about 75 to about 85% wet pick-up.

After application of pretreatment, the fabric is typically dried in any convenient manner, generally at a temperature of less than 100° C., until the fabric is dry. The final percent moisture is (approximately) equal to the equilibrium moisture of the pre-treated fabric at ambient temperature, and can vary somewhat depending on the relative humidity of the surrounding air.

The resins remaining in the fabric after drying provide the absorbent layer for the inkjet inks during printing. It will be appreciated that sufficient resin must be present to absorb the ink load applied. On the other hand, the presence of too much resin may prevent proper penetration. Routine optimization will reveal appropriate coating levels for a given printer and ink set.

The pre-treated fabric should be kept clean, dry and below 50% relative humidity prior to printing.

Printing Method

Printing can be accomplished by any inkjet printer equipped for handling and printing fabric. Commercial printers include, for example, the Dupont™ Artistri™ 3210 and 2020 printers, and the Mimaki TX series of printers.

The amount of ink laid down on the fabric can vary by printer model, by print mode (resolution) within a given printer and by the percent coverage need to achieve a given color. The combined effect of all these considerations is grams of ink per unit area of fabric for each color. In one embodiment, ink coverage is preferably from about 5 to about 17 grams of ink per square meter of fabric. There is a balance between the ink density needed to achieve a desired color and the absorption capacity of the coating resins in the pretreatment.

The digitally printed fabric will typically be post-treated according to procedures well known in the textile art. Preferably, the digitally printed fabric should be stored at 25° C. and less than 50% relative humidity (but for no more than 3 days) prior to fixation.

Preferably the fixation can be done by either Thermofix (dry heat fix) at 200° C. (392° F.) for 60 seconds (done in tenter frame or stenter), pressure steam fix at 140° C. (284° F.) for 25 minutes (recommended for textured yarn), or superheated steam fix at 170-180° C. (338° F.-356° F.) for 7-10 minutes (recommended for textured yarn).

After the fixation, the preferable wash-off utilizes the following steps: (1) rinse in cold water for 10-15 minutes; and (2) fill bath at 70° C. (158° F.) and reduction clear (remove excess dye) for 10-15 minutes using 1 gram per liter NaOH (Sodium hydroxide), 2 grams per liter $Na_2S_2O_4$ (Sodium hydrosulfite) and 1 gram per liter anionic surfactant.

Any anionic surfactant recommended for washing of disperse dyes on polyester can be used.

EXAMPLES

Preparation of Dispersant Polymer

A 12-liter flask was equipped with a mechanical stirrer, thermometer, $N_2$ inlet, drying tube outlet, and addition funnels. Tetrahydrofuran (THF, 3750 gm) and p-xylene (7.4 gm) were charged to the flask. A catalyst (tetrabutyl ammonium m-chlorobenzoate, 3.0 ml of a 1.0 M solution in acetonitrile) was then added. Initiator (1,1-bis(trimethylsiloxy)-2-methyl propene, 291.1 gm (1.25 moles)) was injected. Feed I (tetrabutyl ammonium m-chlorobenzoate, 3.0 ml of a 1.0 M solution in acetonitrile) was started and added over 180 minutes. Feed II (trimethylsilyl methacrylate, 1975 gm (12.5 moles)) was started at 0.0 minutes and added over 35 minutes. One hundred minutes after Feed II was completed (over 99% of the monomers had reacted), Feed III (benzyl methacrylate, 2860 gm (16.3 moles)) was started and added over 30 minutes.

At 400 minutes, 720 gm of methanol was added to the above solution and distillation begun. During the first stage of distillation, 1764.0 gm of material was removed. Then more methanol (304.0 gm) was added and an additional 2255.0 gm of material was distilled out. The remaining polymer solution was 49.7 wt % solids. 2-pyrrolidone (2-P) was then added to obtain a 40 wt % solution of the block copolymer with 55 wt % 2-P.

The block copolymer had a composition of BZMA//MAA 13//10, with a molecular weight (Mn) of 3,200 and an acid value of 3.52.

Preparation of Disperse Dye Dispersion 12.5 parts by weight of the dispersant solution of the 13//10 block copolymer was added to 25 parts by weight of dye and water to make up 77 parts by weight. The block copolymer was neutralized with N,N-dimethylethanolamine, and this was mixed with a high-speed dispersion blade type mixer until a uniform, fluid mixture was obtained. An additional 6 parts by weight water was then added.

This dye dispersion was processed in a bead mill until the mean particle size of 0.05 to 0.2 microns was obtained. This was let down with about 17 parts by weight water to obtain a dye dispersion with 25 wt % dye solids and 5 wt % dispersant solids.

Inks were prepared according to the formulations in the following tables wherein amounts are ink weight percent of the total weight of ink. The dispersion of the dye was added to the other ink components to prepare the inks. Colorants were "inkjet grade" meaning that they were relatively pure and free of excessive amounts of salts. The colorants were used as received or further purified by common techniques for disperse dyes such that sufficient purity was obtained for application in inkjet printing. In each case the dispersed dye/dispersant ratio was 5. N,N-dimethylethanolamine was used to adjust pH. Surfynol® 440 is a surfactant from Air Products Corp (Allentown, Pa., USA). Proxel™ GXL is a Biocide from Avecia (Wilmington, Del., USA). Dowanol® DPM was obtained from Dow Chemical (Midland Mich.).

TABLE I

Disperse Dye Ink Examples

| (all weights as weight %) | Red | Magenta | Light Mag. | Cyan-1 | Light Cyan-1 | Yellow | Cyan-2 | Black | Light Black | Violet |
|---|---|---|---|---|---|---|---|---|---|---|
| Ethylene Glycol | 23.0 | 23.0 | 23.0 | 23.0 | 23.0 | 23.0 | 23.0 | 23.0 | 21.0 | 23.0 |
| Glycerol | 7.0 | 8.0 | 13.0 | 13.0 | 13.0 | 8.0 | 13.0 | 8.0 | 9.5 | 9.0 |
| LEG-1 | 10.0 | 7.0 | 9.0 | 9.0 | 9.0 | 8.0 | 9.0 | 4.0 | 10.0 | 9.0 |
| Dowanol ® DPM | 5.0 | 5.0 | 5.0 | 5.0 | 5.0 | 5.0 | 5.0 | 5.0 | 5.0 | 5.0 |
| Surfynol ® 440 | 1.0 | 1.0 | 1.0 | 1.0 | 1.0 | 1.0 | 1.0 | 1.0 | 0.65 | 1.0 |
| Polyethylene glycol | — | — | 1.0 | — | 1.0 | — | 1.0 | — | 3.5 | — |
| Proxel ™ GXL | 0.15 | 0.15 | 0.15 | 0.15 | 0.15 | 0.15 | 0.15 | 0.15 | 0.20 | 0.15 |
| 2-Pyrrolidone | 0.4 | 0.4 | 0.4 | 0.4 | 0.4 | 0.4 | 0.4 | 0.72 | — | 0.4 |
| Disperse Dye in Dispersion (wt % dye) | DR177 (5.0) | DR92 (6.9) | DR92 (0.5) | DB60 (5.0) | DB60 (0.5) | DY114 (5.0) | DB77 (5.0) | Footnote 1 | Footnote 2 | DV57 (4.0) |
| Water | Bal. to 100% | Bal. to 100% | Bal. to 100% | Bal. to 100% | Bal. to 100% | Bal. to 100% | Bal. to 100% | Bal. to 100% | Bal. to 100 | Bal. to 100% |
| Properties | | | | | | | | | | |
| pH | 8.4 | 8.4 | 8.3 | 8.4 | 8.4 | 8.4 | 8.4 | 8.5 | 8.5 | 8.4 |
| Viscosity (cps, 25° C.) | 8.0 | 7.2 | 8.0 | 8.0 | 8.0 | 7.5 | 7.5 | 8.1 | 8.1 | 8.0 |
| Surface Tension (dyne/cm at 25° C.) | 30.0 | 30.1 | 30.0 | 30.0 | 30.0 | 30.0 | 30.0 | 31.3 | 31.3 | 28.4 |

Footnote 1 - Black dye is a combination of DV63 (1.5 wt %), DO29 (3.5 wt %) and DB291:1 (5.0 wt %).
Footnote 2 - Black dye is a combination of DY114 (0.2 wt %), DB77 (1.2 wt %) and DR92 (0.6 wt %).

Each of these inks were tested for long term storage stability by heating to 70° C. for 1 week, and then the physical properties were retested. If the physical property differences are less than ±20%, the ink was judged to be stable. Each of the inks listed above passed this test and were considered to be stable.

Print Tests

A DuPont™ Artistri™ 2020 printer was equipped with the an ink set containing red, cyan, magenta, yellow, violet, black, light cyan and light magenta disperse dye inks as described above. Tests were conducted on polyester fabrics (from Pacific Coast Fabrics, Gardenia, Calif.) that had been pretreated in a manner as generally described above. After printing, the blocks were autoclaved at 120° C./60 minutes and reduction cleared at 70° C./10 minutes. After post treatment, the prints all showed good color and good penetration.

Each of the red, cyan, magenta, yellow, black, violet, light cyan and light magenta inks, as well as mixtures of two at a time, were printed in 1 cm squares that were different percent coverage of each ink in 15 steps, at 10%, 40% and 100% coverage. The resulting 375 colored squares were each measured with Spectrolino Instrument made by Gretag Macbeth, New Windsor, N.Y. Measurements were taken and the gamut volume calculated as described in the US2004/0100643 (the disclosure of which is incorporated by reference herein for all purposes as if fully set forth). A CMYKVcmk comparative set was printed according to the same process. Gamut volume was calculated for the inventive and comparative inks and are shown as Example Ink and Comparative Ink in Table II.

TABLE II

Gamut Expansion of Disperse Dye set with DR177

| Ink | Printed Polyester Fabric | Dpi | Gamut Volume |
|---|---|---|---|
| Example Ink Set | | | |
| RCMYKVcm | 600 Denier | 360 | 382,700 |
| RCMYKVcm | Interlock | 360 | 390,100 |
| RCMYKVcm | 600 Denier | 540 | 389,300 |
| RCMYKVcm | Interlock | 540 | 399,300 |

TABLE II-continued

Gamut Expansion of Disperse Dye set with DR177

| Ink | Printed Polyester Fabric | Dpi | Gamut Volume |
|---|---|---|---|
| Comparative Ink Set | | | |
| CMYKVcmk | 600 Denier | 360 | 362,800 |
| CMYKVcmk | Interlock | 360 | 383,900 |
| CMYKVcmk | 600 Denier | 540 | 372,200 |
| CMYKVcmk | Interlock | 540 | 371,500 |

The invention claimed is:

1. An inkjet ink set comprising at least four differently colored inks, wherein:

at least one of the colored inks is red in color and comprises a first aqueous vehicle and a red disperse dye colorant selected from the group consisting of DR177, DR229, DR258 and mixtures thereof;

at least one of the colored inks is cyan in color and comprises a second aqueous vehicle and a cyan disperse dye colorant, wherein the cyan disperse dye colorant comprises DB60;

at least one of the colored inks is magenta in color and comprises a third aqueous vehicle and a magenta disperse dye colorant selected from the group consisting of DR5, DR75, DR76, DR121, DR132, DR179, DR184, DR189, DR191 and mixtures thereof;

at least one of the colored inks is yellow in color and comprises a fourth aqueous vehicle and a yellow disperse dye colorant selected from the group consisting of DY27, DY33, DY50, DY59, DY98, DY114, DY139, DY140, DY201, DY206, DY231 and mixtures thereof.

2. The inkjet ink set of claim 1, further comprising a violet colored ink comprising a fifth aqueous vehicle and a disperse dye colorant selected form the group consisting of DV37, DV57, DV63, DV99 and mixtures thereof.

3. The inkjet ink set of claim 1, further comprising an ink that is black in color comprising a sixth aqueous vehicle and a black disperse dye colorant.

4. The inkjet ink set of claim 3, wherein the black disperse dye colorant comprises a mixture of DB 291:1, DO29, and one or both of DV 63 or DV 99.

5. The inkjet ink set of claim 3, wherein the black disperse dye colorant comprises a mixture of DB77, DR92 and DY114.

6. The inkjet ink set of claim 2, further comprising an ink that is black in color comprising a sixth aqueous vehicle and a black disperse dye colorant.

7. The inkjet ink set of claim 1, further comprising a light magenta ink comprising an aqueous vehicle and a magenta disperse dye colorant, and a light cyan ink comprising an aqueous vehicle and a cyan disperse dye colorant.

8. The inkjet ink set of claim 6, further comprising a light magenta ink comprising an aqueous vehicle and a magenta disperse dye colorant, and a light cyan ink comprising an aqueous vehicle and a cyan disperse dye colorant.

9. A method for ink jet printing onto a fabric substrate, comprising the steps of:

(a) providing an ink jet printer that is responsive to digital data signals;

(b) loading the printer with a fabric substrate to be printed;

(c) loading the printer with an inkjet ink set comprising at least four differently colored inks; and (d) printing a print onto the fabric substrate using the inkjet ink set in response to the digital data signals, wherein:

at least one of the colored inks is red in color and comprises a first aqueous vehicle and a red disperse dye colorant selected from the group consisting of DR177, DR229, DR258 and mixtures thereof;

at least one of the colored inks is cyan in color and comprises a second aqueous vehicle and a cyan disperse dye colorant, wherein the cyan disperse dye colorant comprises DB60;

at least one of the colored inks is magenta in color and comprises a third aqueous vehicle and a magenta disperse dye colorant selected from the group consisting of DR5, DR75, DR76, DR121, DR132, DR179, DR184, DR189, DR191 and mixtures thereof;

at least one of the colored inks is yellow in color and comprises a fourth aqueous vehicle and a yellow disperse dye colorant selected from the group consisting of DY27, DY33, DY50, DY59, DY98, DY114, DY139, DY140, DY201, DY206, DY231 and mixtures thereof.

10. The method of claim 9, wherein the ink set further comprises a violet colored ink comprising a fifth aqueous vehicle and a disperse dye colorant selected form the group consisting of DV37, DV57, DV63, DV99 and mixtures thereof.

11. The method of claim 9, wherein the ink set further comprises an ink that is black in color comprising a sixth aqueous vehicle and a black disperse dye colorant.

12. The method of claim 11, wherein the ink set further comprises a light magenta ink comprising an aqueous vehicle and a magenta disperse dye colorant, and a a light cyan ink comprising an aqueous vehicle and a cyan disperse dye colorant.

13. The method of claim 9, further comprising the steps of:

(e) fixing the disperse dye inks, and (f) washing the digitally printed fabric.

14. The method of claim 9, wherein the fabric substrate is a polyester or polyester blend.

* * * * *